US012018885B2

(12) United States Patent
Ji

(10) Patent No.: US 12,018,885 B2
(45) Date of Patent: Jun. 25, 2024

(54) REFRIGERATOR

(71) Applicant: LG ELECTRONICS INC., Seoul (KR)

(72) Inventor: Sun Kook Ji, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 331 days.

(21) Appl. No.: 17/496,277

(22) Filed: Oct. 7, 2021

(65) Prior Publication Data

US 2022/0120494 A1 Apr. 21, 2022

(30) Foreign Application Priority Data

Oct. 19, 2020 (KR) ..... 10-2020-0135196

(51) Int. Cl.

| | |
|---|---|
| ***F25D 25/02*** | (2006.01) |
| ***F25D 23/02*** | (2006.01) |
| ***F25D 23/06*** | (2006.01) |
| ***F25D 29/00*** | (2006.01) |

(52) U.S. Cl.

CPC ..... *F25D 29/00* (2013.01); *F25D 25/025* (2013.01); *F25D 29/005* (2013.01); *F25D 2700/02* (2013.01)

(58) Field of Classification Search

CPC ..... F25D 29/00; F25D 25/025; F25D 29/005; F25D 2700/02

USPC ..... 318/554

See application file for complete search history.

(56) References Cited

U.S. PATENT DOCUMENTS

| | | | | |
|---|---|---|---|---|
| 10,066,869 | B2 | 9/2018 | Lee et al. | |
| 10,712,083 | B1 | 7/2020 | Choi | |
| 2009/0248205 | A1 | 10/2009 | Yu et al. | |
| 2020/0173712 | A1* | 6/2020 | Choi | F25D 25/025 |
| 2020/0173714 | A1* | 6/2020 | Du | F25D 27/005 |

FOREIGN PATENT DOCUMENTS

| | | | |
|---|---|---|---|
| KR | 10-2009-0102576 | A | 9/2009 |
| KR | 10-2009-0102577 | A | 9/2009 |
| KR | 10-2013-0071919 | A | 7/2013 |
| KR | 10-2018-0138083 | A | 12/2018 |

OTHER PUBLICATIONS

Uchiya (JP H07159024 A) "Freezing Refrigerator" Date Published Jun. 20, 1995 (Year: 1995).*

European Search Report dated Mar. 11, 2022 issued in EP Application No. 21201105.0.

* cited by examiner

*Primary Examiner* — Jorge L Carrasquillo

(74) *Attorney, Agent, or Firm* — KED & ASSOCIATES, LLP

(57) ABSTRACT

A refrigerator is proposed. When a drawer of the refrigerator is completely opened, the center of an opening-detection magnet provided at the lower surface of the drawer may be disposed by exceeding the center of the sensor of a reed switch, in a moving direction of the drawer, installed at the bottom surface of the inside of the cabinet. Accordingly, the sensor may accurately detect the magnet, and even if external impact is applied to the drawer in the completely opened state of the drawer, the malfunction of the drawer which is closed unintentionally may be prevented.

19 Claims, 19 Drawing Sheets

REFRIGERATOR

CROSS-REFERENCE TO RELATED APPLICATION(S)

The present application claims priority to Korean Patent Application No. 10-2020-0135196, filed in Korea on Oct. 19, 2020, the entire contents of which is incorporated herein for all purposes by this reference.

BACKGROUND

1. Field

The present disclosure relates to a refrigerator having a drawer which is automatically opened.

2. Background

Generally, a refrigerator is a household appliance which stores various foods or beverages for a long time with cold air produced by circulation of refrigerant according to a refrigeration cycle. Such a refrigerator is provided by being divided into a refrigerator which can commonly store goods irrespective of the kinds of the goods such as food or beverages to be stored, and a dedicated refrigerator having a size or function different from each other according to the kinds of goods to be stored.

In addition, the refrigerator may be classified into a refrigerator having a swinging door, a refrigerator having a drawer, and a hybrid-type refrigerator depending on the opening and closing method of a door by which a storage compartment in a cabinet is opened and closed. Here, the hybrid-type refrigerator has a structure in which a swinging door is provided in an upper portion of the cabinet and a drawer is provided in a lower portion thereof. The drawer provided in the drawer-type refrigerator or the hybrid-type refrigerator is opened slidably from an inside space of the cabinet by user's pulling, or the drawer is closed by being pushed into the inside space of the cabinet by user's pushing such that the open portion of the cabinet is closed.

The drawer includes a front panel constituting a front surface of the drawer and configured to open and close the inside space of the cabinet and a receiving part provided at the rear of the front panel and received the inside space of the cabinet. By pulling the front panel, the receiving part is opened from the inside space of the cabinet, and thus various foods can be stored in and taken out from the receiving part.

Meanwhile, the drawer provided in the drawer-type refrigerator or the hybrid-type refrigerator is mainly provided in the lower portion of the cabinet. This is because, due to the weight of items stored in the storage room of the drawer, the drawer may be removed from the cabinet and fall down forward when the drawer is opened. However, in order to open the drawer when the drawer is provided at the lower part of the cabinet, with a user being away by an appropriate distance from the drawer, the user is required to bend at the waist and to pull the front panel.

Accordingly, recently, a variety of refrigerators designed to automatically open the drawer are being researched and developed. This is disclosed in Korean Patent Application Publication No. 10-2009-0102577, Korean Patent Application Publication No. 10-2009-0102576, Korean Patent Application Publication No. 10-2013-0071919, and Korean Patent Application Publication No. 10-2018-0138083.

Meanwhile, in a structure in which the drawer is automatically opened, racks and a pinion are mainly used. That is, each of the racks and the pinion are installed in the storage space of the inside of the cabinet opposite to the drawer such that the drawer can be automatically opened forward.

In addition, in the structure in which the drawer described above is automatically opened, a detection part for detecting the opening and closing of the drawer is provided. That is, when the drawer is opened, whether the drawer is completely opened is detected by the detection part, and when the drawer is closed, whether the drawer is completely closed is detected by the detection part. Accordingly, the function of the detection part is performed only at an accurate time when the drawer is completely opened or closed.

The detection part normally includes a magnet and a reed switch. That is, the magnet is provided at the drawer, and the reed switch is provided at the cabinet such that whether the drawer is opened or closed can be accurately detected. In this case, the reed switch has a sensor for detecting the magnet. A normal reed switch is configured such that the magnet approaches the sensor while moving in a direction facing the sensor, so the sensor can accurately detect the magnet.

However, the reed switch applied to the drawer is disposed such that the magnet corresponds to the position of the sensor while moving in a longitudinal direction of the sensor instead of moving in a direction facing the sensor. Accordingly, when the center of the magnet does not correspond to the center of the sensor, the sensor has detection error when detecting the magnet. Accordingly, even when the drawer is not completely opened or closed, the sensor may malfunction, and thus the drawer may stop.

The problem of the detection error or malfunction of the sensor caused the malfunction of the drawer caused by the movement (for example, the movement of the drawer due to hitting or instantaneous weight change) of the drawer while a user stores or takes out items from the drawer since the drawer is detected to be opened even when the drawer is not completely opened. That is, due to the movement of the drawer, the magnet moves a minute distance away from the sensor. Accordingly, a controller configured to check the detection signal of the reed switch determines this as the manipulation of closing the drawer, so the malfunction of performing the closing operation of the drawer occurs, and thus a user has an accident.

In addition, since the rail assembly of the drawer is located in the space in which cold air flows, the opening distance of the drawer may be different depending on environmental conditions such as the influence of the cold air, the influence of pressure difference in the refrigerator, the weight of stored items, and the misalignment of a gear, and the like. Accordingly, a case in which the centers of the sensor and the magnet do not coincide with each other frequently occurs, which inevitably causes the detection error or malfunction due to the detection error.

BRIEF DESCRIPTION OF THE DRAWINGS

Embodiments will be described in detail with reference to the following drawings in which like reference numerals refer to like elements, and wherein.

DETAILED DESCRIPTION

Hereinafter, an exemplary embodiment of a refrigerator of the present disclosure will be described with reference to FIGS. 1 to 19. Prior to the description of the embodiment, the refrigerator of the present disclosure including an opening-detection magnet and a reed switch may be a refrigerator configured such that a container is provided inside a drawer and the container is moved up and down by a lift module.

Figure 1:
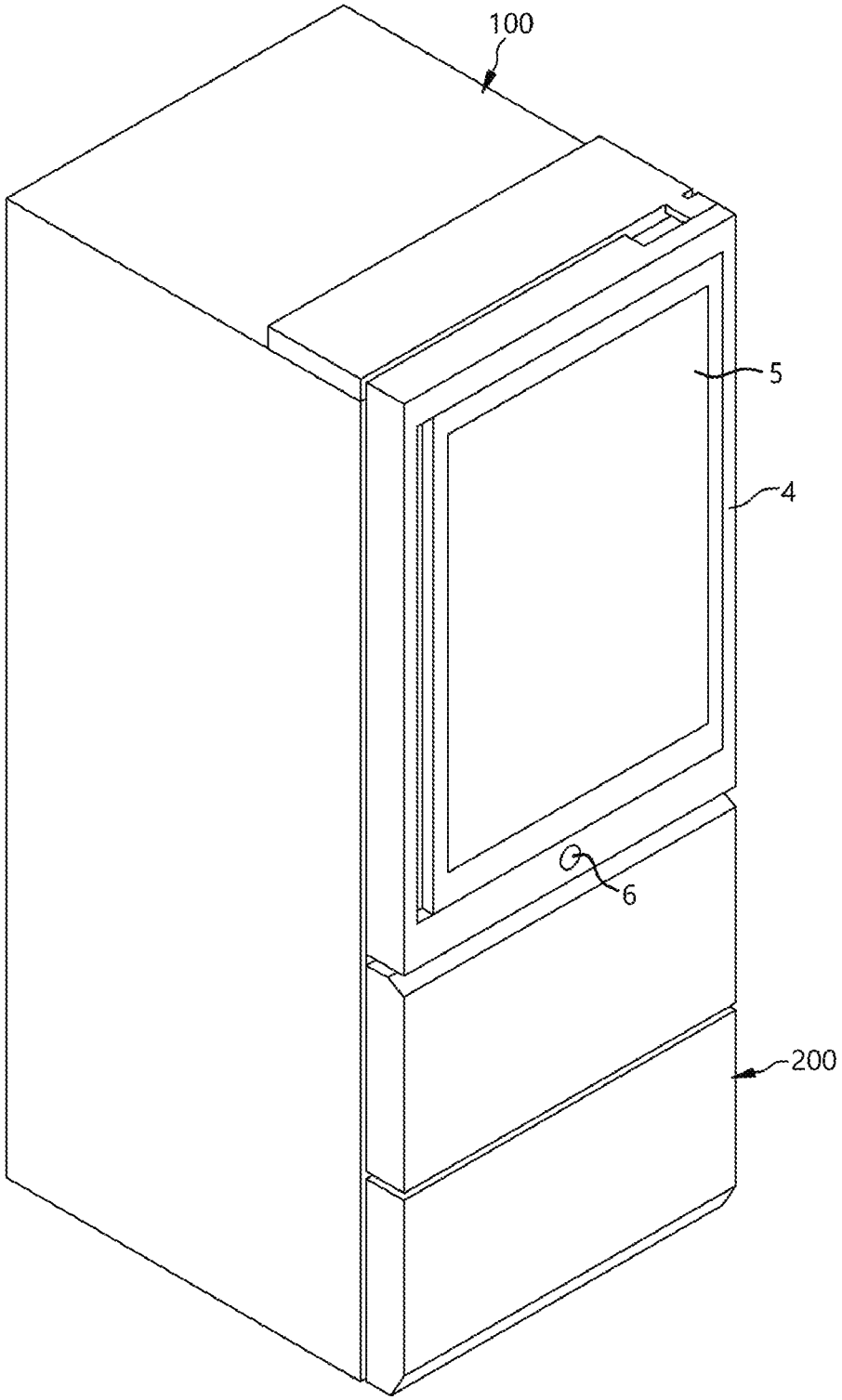
FIG. 1 is a perspective view illustrating a refrigerator according to an embodiment of the present disclosure.
Figure 2:
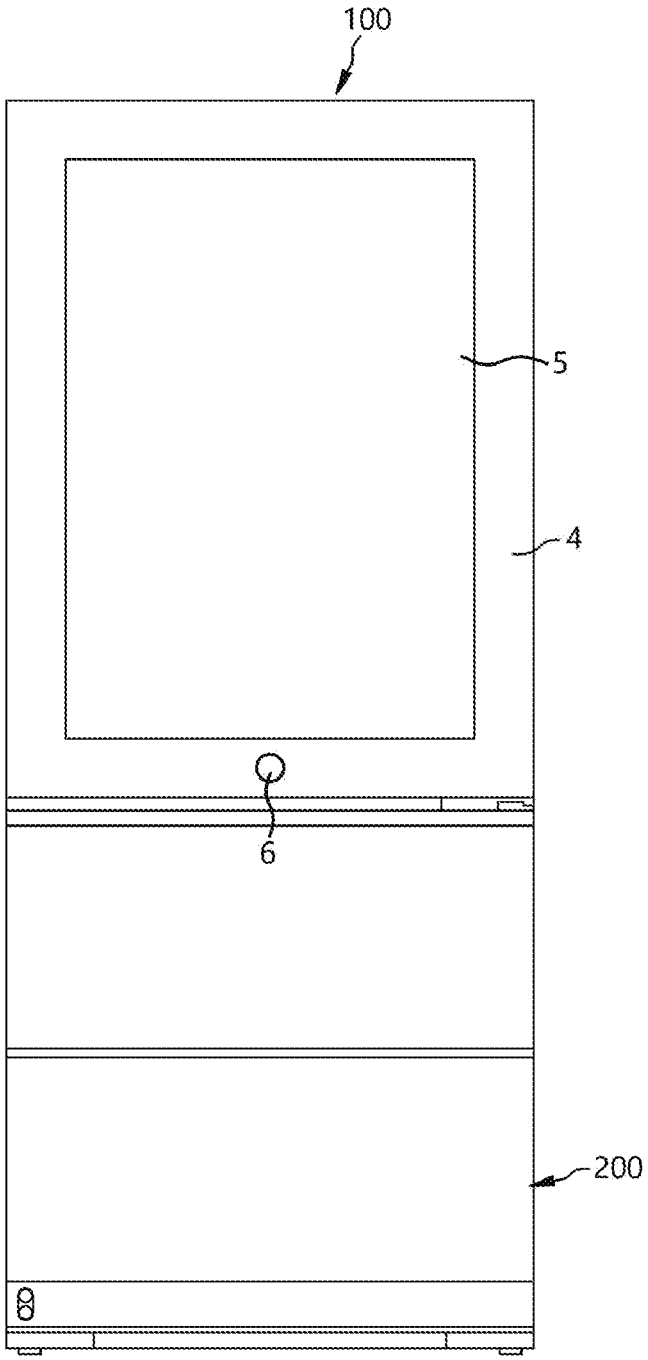
FIG. 2 is a front view illustrating the refrigerator according to the embodiment of the present disclosure.
Figure 3:
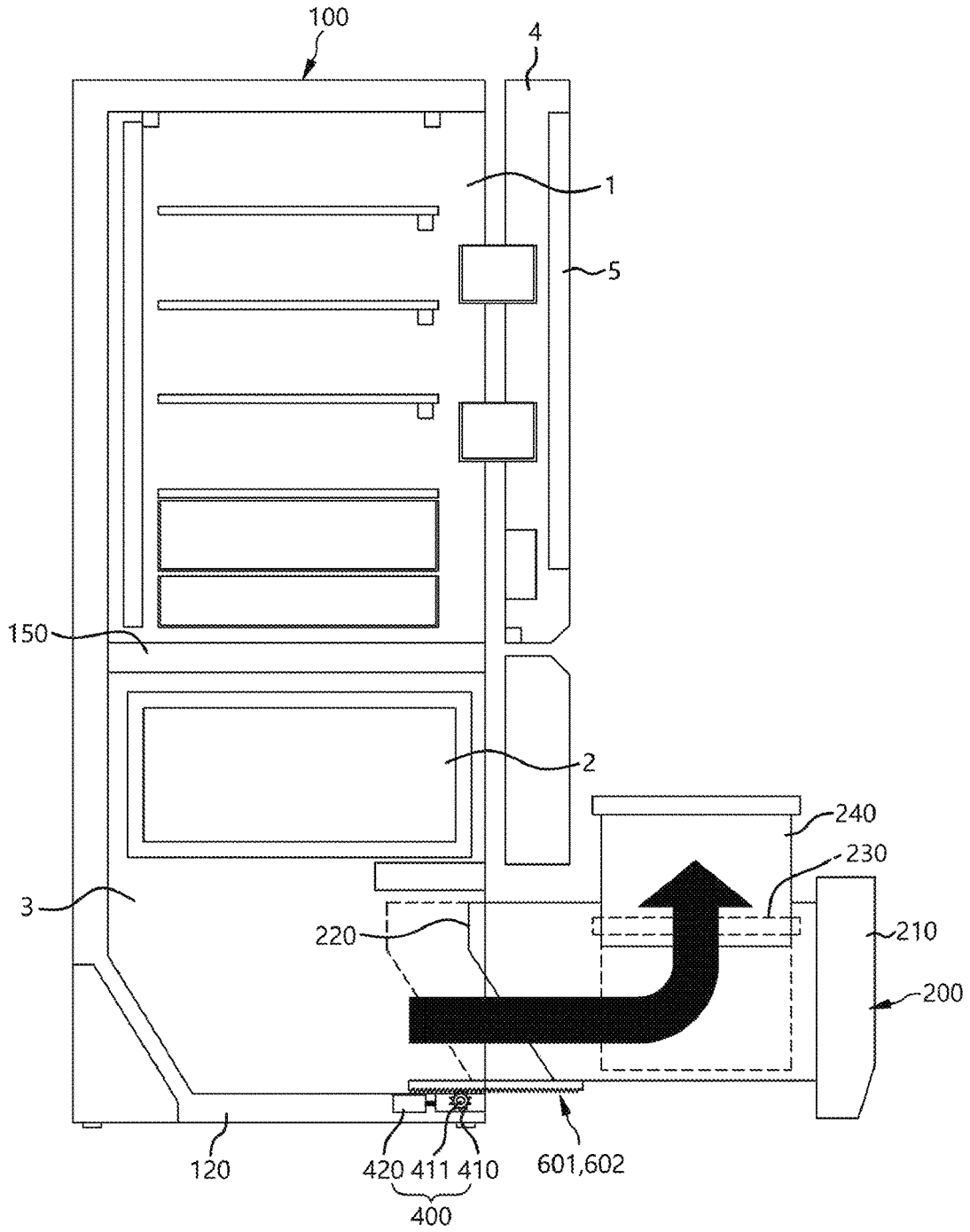
FIG. 3 is a side view illustrating the refrigerator according to the embodiment of the present disclosure.

FIG. 1 is a perspective view illustrating the refrigerator according to the embodiment of the present disclosure; FIG. 2 is a front view illustrating the refrigerator according to the embodiment of the present disclosure; and FIG. 3 is a side view illustrating the refrigerator according to the embodiment of the present disclosure.

Figure 4:
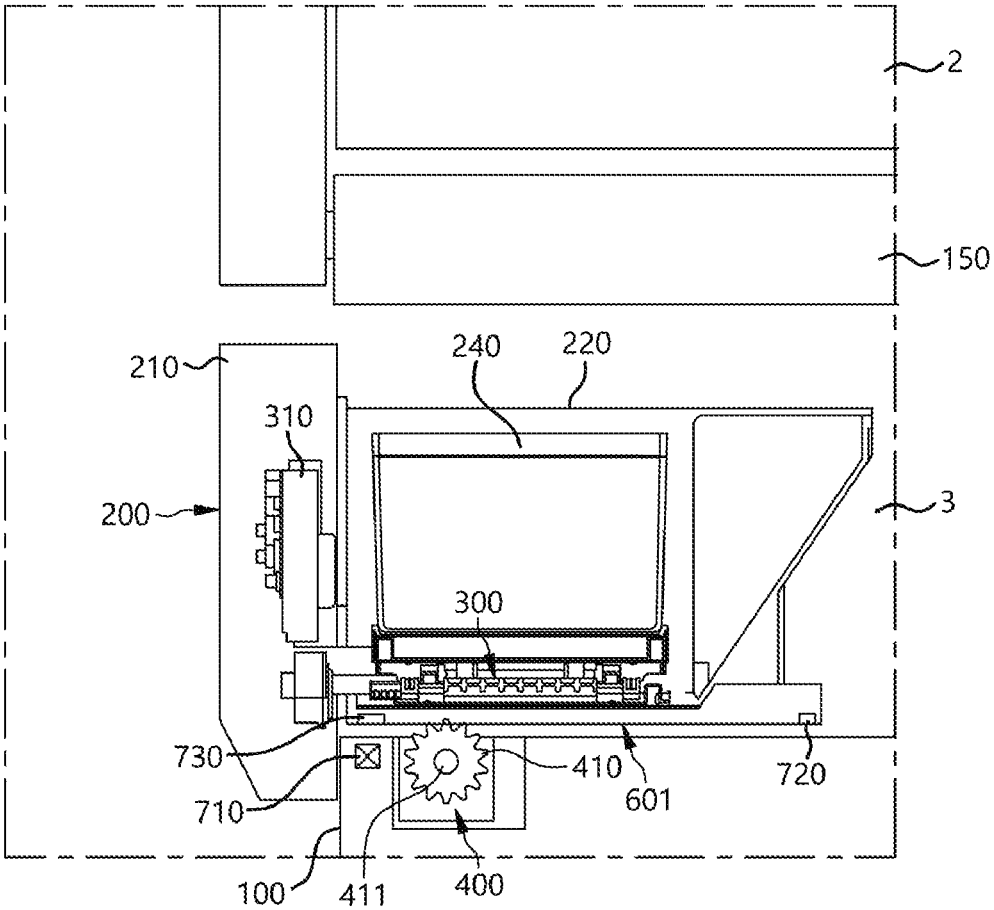
FIG. 4 is a state view of an important part roughly illustrating the closed state of a drawer of the refrigerator according to the embodiment of the present disclosure.
Figure 5:
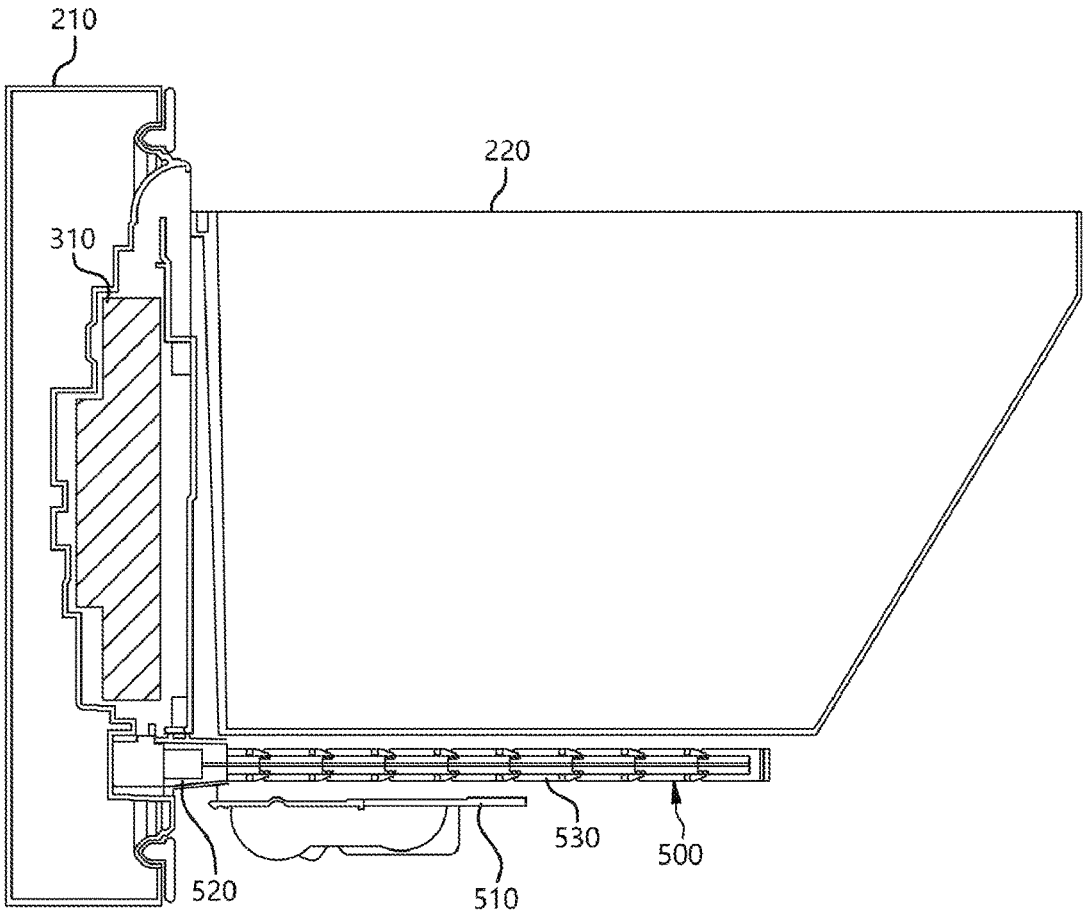
FIG. 5 is a side view illustrating a state in which a wire guide module is connected to the drawer of the refrigerator according to the embodiment of the present disclosure.
Figure 6:
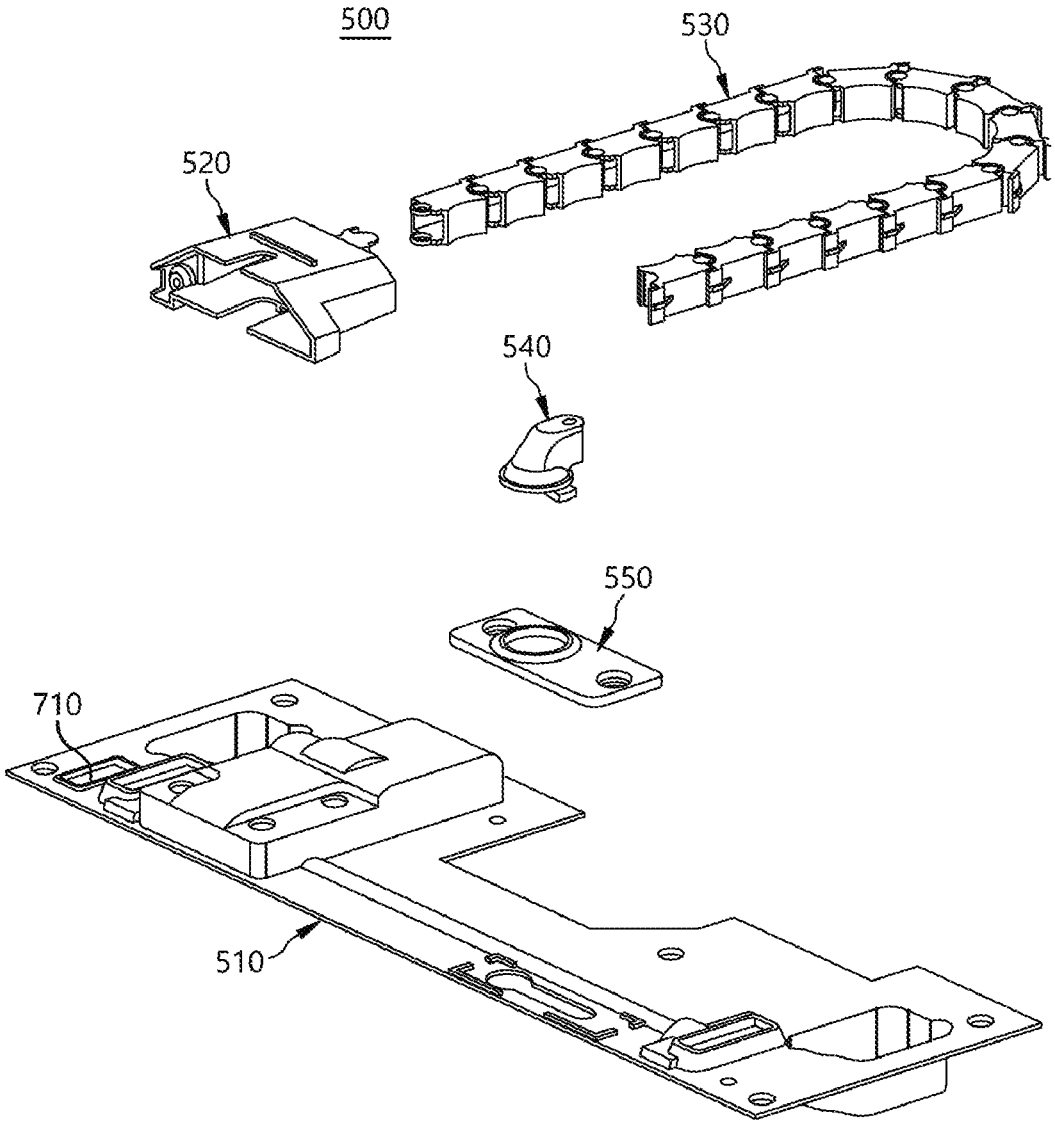
FIG. 6 is an exploded perspective view illustrating the wire guide module of the refrigerator according to the embodiment of the present disclosure.
Figure 7:
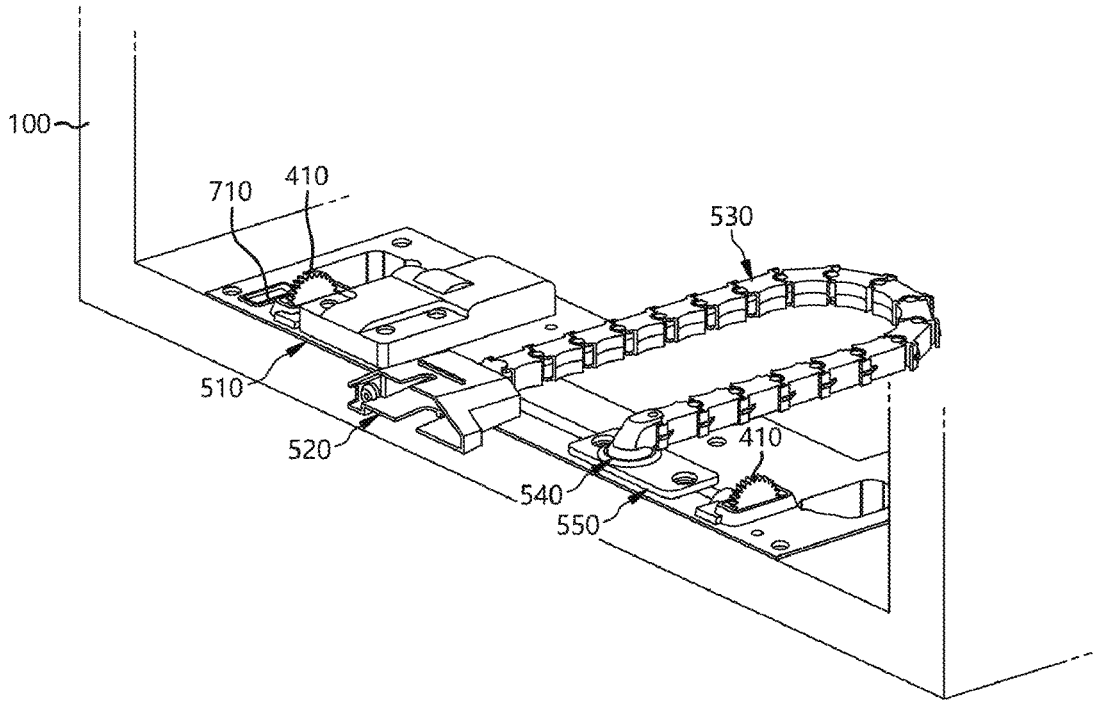
FIG. 7 is a perspective view illustrating a state in which the wire guide module of the refrigerator according to the embodiment of the present disclosure is installed inside a storage compartment.
Figure 8:
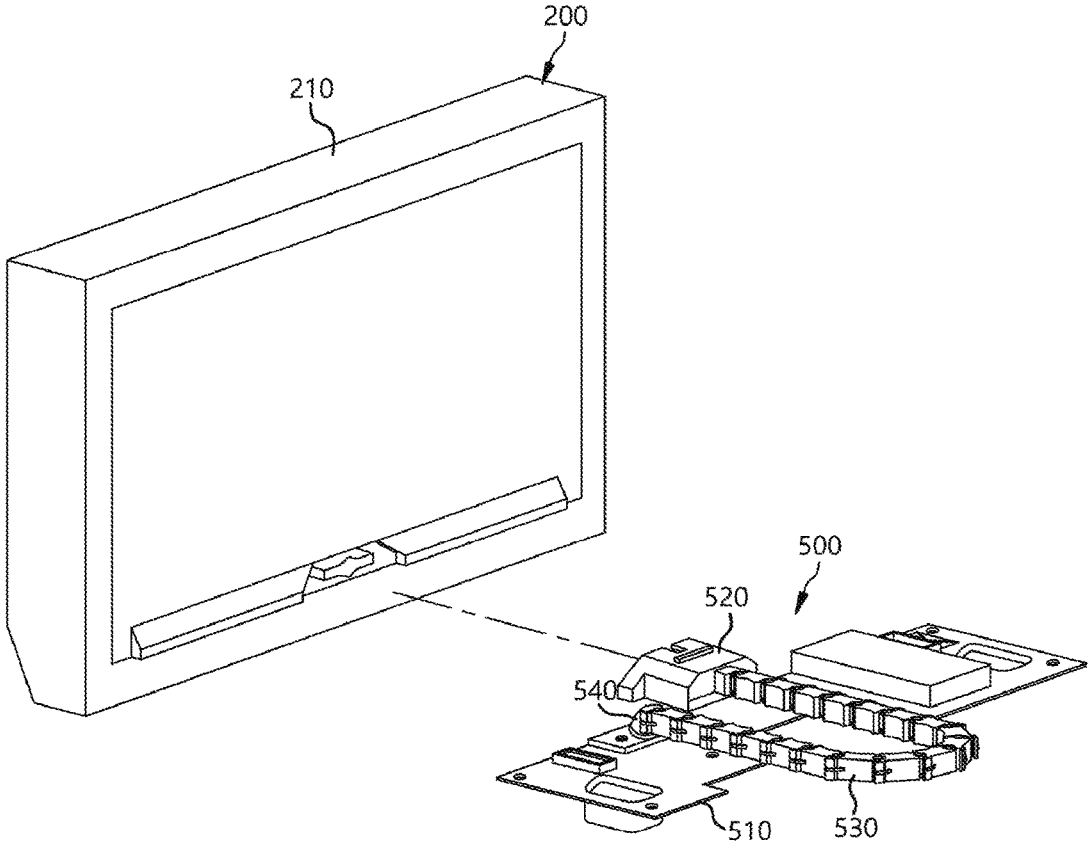
FIG. 8 is a perspective view illustrating the state in which the wire guide module of the refrigerator according to the embodiment of the present disclosure is connected to the drawer when seeing from the rear side of the drawer.

As illustrated in these drawings, the refrigerator according to the embodiment of the present disclosure may largely include a cabinet 100, a drawer 200, an opening-detection magnet (or first magnet) 720, and a reed switch 710 (see FIG. 4). Particularly, when the drawer 200 is completely opened, the center C1 of the opening-detection magnet 720 may be disposed to be located at a position exceeding the center C2 of the sensor 711 of the reed switch 710 (see FIG. 13). Each configuration of the refrigerator according to the embodiment of the present disclosure will be described.

First, the refrigerator according to the embodiment of the present disclosure may include the cabinet 100. The cabinet 100 is a part which constitutes the exterior of the refrigerator. Such a cabinet 100 may be configured to have a shape of a box open forward.

In addition, one or at least two partition walls 150 may be provided inside the cabinet 100. The partition wall 150 may be installed to divide a storage space inside the cabinet 100 into a plurality of spaces, and the storage space may have a plurality of storage compartments 1, 2, and 3 formed by being separated from each other by each of such partition walls 150. Of course, the partition wall 150 may be provided to horizontally divide the storage space in the cabinet 100.

In the refrigerator according to the embodiment of the present disclosure, three storage compartments divided vertically are provided, wherein an upper storage compartment 1 may be used as a refrigerating compartment, and each of a middle storage compartment 2 and a lower storage compartment 3 may be used as a refrigerating compartment or a freezer compartment, or as a separate independent space.

Particularly, storage compartments 1, 2, and 3 of the cabinet 100 may be configured to be opened by a door or drawers, respectively. In this case, the upper storage compartment 1 may be opened by a swinging door 4, and each of the middle storage compartment 2 and the lower storage compartment 3 may be opened by the drawer 200. Of course, although not shown, the middle storage compartment 2 may be configured to be opened by the swinging door 4. The swinging door 4 may be coupled rotatably to the cabinet 100, and due to such rotation of the swinging door, the upper storage compartment 1 may be opened or closed.

In addition, a display part 5 may be provided on the front surface of the swinging door 4 so as to output information. That is, various information such as the operation state of the refrigerator or the temperature of each storage compartment 1, 2, or 3 may be displayed by the display part 5. The display part 5 may be variously configured as a liquid crystal display or an LED.

Next, the refrigerator according to the embodiment of the present disclosure may include the drawer 200. The drawer 200 may be configured to be opened and closed in a sliding method. In the following embodiment, the drawer 200 may be provided in the lower storage compartment 3.

Such a drawer 200 may be composed of a front panel 210 and a receiving part 220. Here, the front panel 210 may be a part closing the lower storage compartment 3 by blocking the open front thereof and may be configured to have an installation space therein.

Particularly, the front panel 210 may be formed to have each wall surface (a top surface, opposite side surfaces, a front surface, and a lower surface) by bending a thin metal plate multiple times. In addition, the inside of the front panel 210 may be provided with an internal frame (not shown) made of resin for the weight reduction and productivity improvement of the front panel. Of course, the front panel 210 may also be formed of a material that has a metal texture.

In addition, the receiving part (or receiving tray) 220 may be provided at the rear of the front panel 210 and may be a part which is received in the lower storage compartment 3. The receiving part 220 may be configured to have the shape of a box open upward, and the front surface of the receiving part 220 may be coupled to the rear surface of the front panel 210. In this case, the receiving part 220 and the front panel 210 may be coupled to each other in various methods such as hooking, bolting, screwing, engaging, and fitting.

Particularly, guide rails 230 (See FIG. 3) may be provided on the opposite outer surfaces of the receiving part 220, respectively, and on the opposite wall surfaces, respectively, of the inside of the lower storage compartment 3 opposing thereto. Each of the guide rails 230 may be installed to be engaged with each other and may support the forward and rearward movements of the receiving part 220.

Although not shown, each of the guide rails 230 may be installed on the lower surface of the receiving part 220 and the bottom surface of the inside of the lower storage compartment 3 facing the lower surface of the receiving part 220 and may be coupled to each other to be engaged with each other. In addition, each of the guide rails 230 may be configured to extend at multiple levels.

In addition, a separate container 240 may be provided in the receiving part 220. That is, various foods may be stored in the receiving part 220, but the container 240 may be placed in the receiving part 220 such that various foods may be stored in the container 240. In this case, the container 240 may be, for example, a kimchi container, or may be a basket having an open top surface.

Particularly, it is more preferable that the container 240 is configured to move up inside the receiving part 220 when the receiving part 220 is opened from the lower storage compartment 3. That is, in order for a user to lift the container 240 placed in the receiving part 220, a sufficient gap in which the user's finger enters may be required between the receiving part 220 and the container 240, and the size of the container 240 may be required to be reduced by the gap. Accordingly, in order to maximize the size of the container 240, it is best to allow the container 240 to automatically move out of the receiving part 220. Of course, when the container 240 is automatically removed from the receiving part 220, the withdrawal of the container 240 by the user may not be required.

To this end, the lift module 300 (See FIGS. 4, 18, and 19) may be provided in the receiving part 220 so as to automatically move the container 240 upward. The lift module 300 may be configured in various shapes. For example, the lift module 300 may be configured as a scissor type link structure such that when the lift module is folded, the height of the lift module can be minimized and when the lift module is unfolded, the height of the lift module can be maximized. Electric parts 310 (e.g., a drive motor, etc.) that provide driving force for moving the lift module 300 upward and downward may be provided in the installation space of the inside of the front panel 210.

Of course, in a case in which the lift module 300 operates before the receiving part 220 of the drawer 200 is completely opened, the container 240 or the cabinet 100 may be damaged. Accordingly, it is more preferable that a control program (not shown) programmed to control the operation of the lift module 300 is programmed to operate only when the receiving part 220 is completely opened.

Next, the refrigerator according to the embodiment of the present disclosure may include a drive part (or drive mechanism) 400. The drive part 400 may be a part that provides driving force for automatic moving the drawer 200 forward and backward.

As illustrated in FIGS. 3 and 4, the drive part 400 may be provided at a bottom part 120 of the cabinet 100 and may include a pinion 410 and a drive motor 420. The pinion 410 may be installed such that a portion of the pinion 410 is installed to be exposed to the inside of the lower storage compartment 3 by being formed upward through the bottom surface (an upper surface of the bottom part) of the lower storage compartment 3 (See FIG. 7), and the drive motor 420 may be provided at the lower part of the lower storage compartment 3 and may be installed to transmit power to the pinion 410.

In the embodiment of the present disclosure, the pinion 410 may be located at each of opposite sides of the bottom surface (the upper surface of the bottom part) of the inside of the lower storage compartment 3. The pinions 410 may be configured to be connected to a power transmission shaft 411, and the drive motor 420 may be connected to the power transmission shaft 411 by a belt, chain or gear such that the drive motor 420 transmit power to the power transmission shaft 411.

That is, the two pinions 410 may be simultaneously rotated at the same speeds and directions by the operation of the drive motor 420. Of course, a reduction gear (not shown) may be provided at a portion at which the power transmission shaft 411 is connected with the drive motor 420. Particularly, the two pinions 410 are preferably located on the most front side of the bottom surface of the lower storage compartment 3. This is to ensure that the drawer 200 can be opened as much as possible.

The drive motor 420 may be operated by detecting the user's proximity or may be operated by a user's manipulation of a button 6. In this case, the button 6 may be configured as a press button and may be disposed at a position at which a user's manipulation is easy. Of course, the button 6 may be a touch-type button provided on the display part 5 of the swinging door 4.

Meanwhile, the bottom surface (the upper surface of the bottom part) of the inside of the lower storage compartment 3 and the front panel 210 may be connected to a wire guide module 500. The wire guide module 500 may configured that the wire guide module 500 protects power lines and wires (hereinafter referred to as "wires") connected to the electric parts located in the front panel 210 among various power lines or wires connected along the bottom part 120.

Particularly, the wire guide module 500 described above may be configured to prevent damage to the wires due to twisting or scratching of the wires while guiding the movement of the wires together with the drawer during the forward and rearward movements of the drawer 200. To this end, the wire guide module 500 may include a cover plate 510, a guiding head 520, multiple connecting members 530, swinging connection member 540, and a mounting plate 550. This is illustrated in FIGS. 5 to 8.

Next, the refrigerator according to the embodiment of the present disclosure may include a rack gear assembly. The rack gear assembly is a device that operates so that the drawer 200 can be automatically moved forward and rearward with the driving force of the drive part 400 provided in the cabinet 100.

Figure 9:
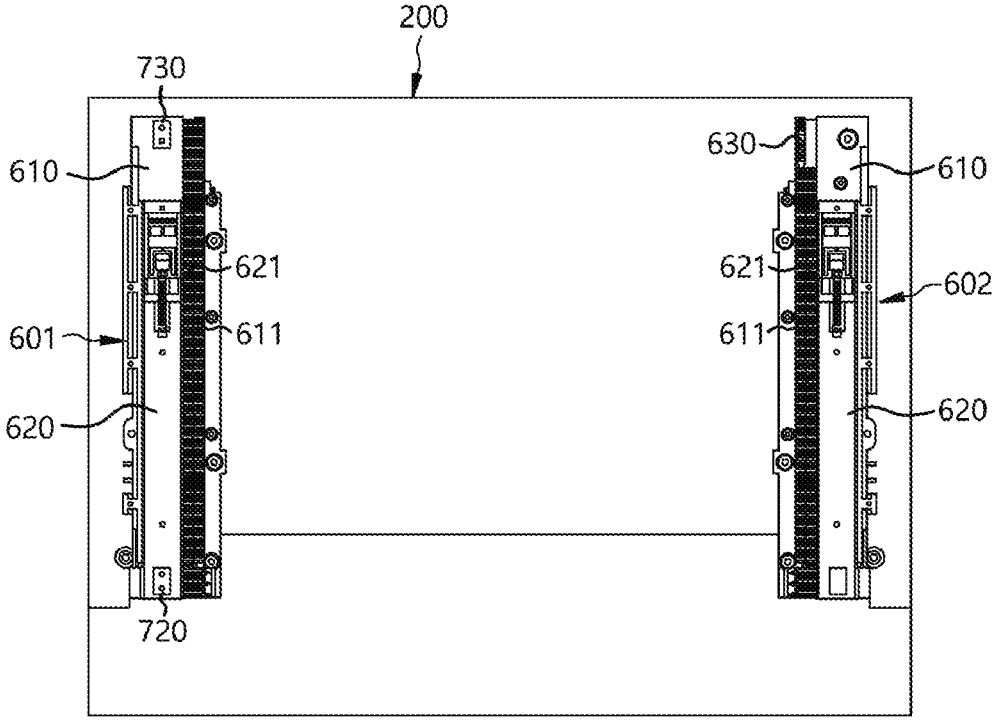
FIG. 9 is a bottom view illustrating the installed state of a rack gear assembly of the refrigerator according to the embodiment of the present disclosure.
Figure 10:
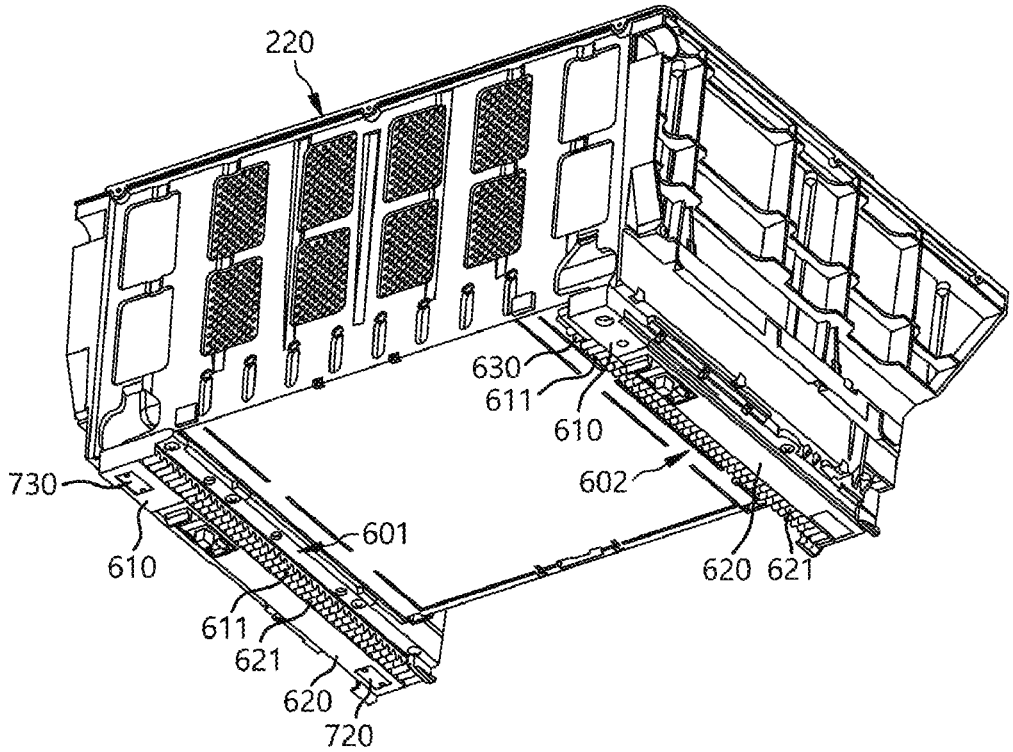
FIG. 10 is a perspective view illustrating the state of the rack gear assembly of the refrigerator according to the embodiment of the present disclosure when seeing the rack gear assembly from a lower portion thereof.
Figure 11:
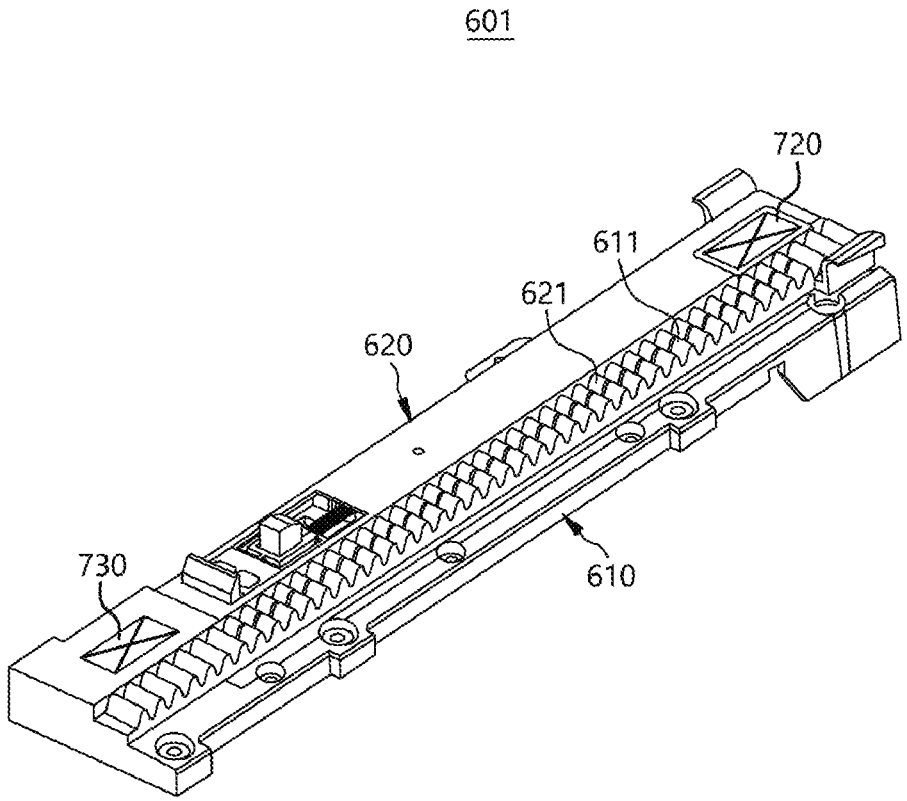
FIG. 11 is a perspective view illustrating the structure of the lower surface of the rack gear assembly of the refrigerator according to the embodiment of the present disclosure when seeing the rack gear assembly upside down.

As illustrated in FIGS. 9 and 10, the rack gear assembly may include a first rack gear assembly 601 provided at any one side of the lower surface of the receiving part 220 constituting the drawer 200 and a second rack gear assembly 602 provided at another side thereof. The racks 611 and 621 may be formed on the lower surface of each of the rack gear assemblies 601 and 602 and may be installed to be engaged with each of the pinions 410 exposed to the inside of the lower storage compartment 3.

In addition, the racks 611 and 621 of each of the rack gear assemblies 601 and 602 may be formed from a front of the lower surface of the receiving part 220 to a rear thereof. Accordingly, the drawer 200 provided with the rack gear assemblies 601 and 602 may be withdrawn from or received in the lower storage compartment 3 by moving forward and rearward, respectively, due to the rotation of the pinion 410. Of course, three or more pairs of pinions 410 and rack gear assemblies 601 and 602 may be provided.

Meanwhile, as the automatically withdrawing distance of the drawer 200 increases, the usability of the drawer 200 may be improved. That is, when the storage room of the inside of the receiving part 220 moves as far as possible from the lower storage compartment 3, the container 240 may be easily received in the drawer 200, or items or foods may be easily stored in the storage room.

Furthermore, when the drawer 200 is opened, the container 240 may be automatically moved up by the lift module 300, so it is preferable to move the receiving part 220 as far as possible from the lower storage compartment 3. To this end, each of the two pinions 410 is preferably located at the front portion of the lower storage compartment 3. In addition, each of the racks 611 and 621 is preferably configured to have as long length as possible.

That is, each of the two pinions 410 may be located at a position near the front end of the lower storage compartment 3, and as the length of each of the racks 611 and 621 increases, the withdrawing distance of the receiving part 220 may increase. However, in consideration that the lower surface of the receiving part 220 is formed to be shorter in a front-to-rear length thereof than the open upper surface of the receiving part 220, there is a limit in lengthening the length of the racks 611 and 621.

Accordingly, each of the rack gear assemblies 601 and 602 according to the embodiment of the present disclosure may be configured to extend length thereof such that the withdrawing distance of the receiving part 220 increases. That is, although the receiving part 220 is short in the front-to-rear length, the length of each of the rack gear assemblies 601 and 602 may extend such that the receiving part 220 can be withdrawn farther.

To this end, each of the rack gear assemblies 601 and 602 may include a first rack member 610 and a second rack member 620 that are sequentially moved forward and withdrawn. In this case, the racks 611 and 621 configured to move forward and rearward due to the rotation of the pinion 410 may be formed in each of the rack members 610 and 620.

In addition, the first rack member 610 may be configured such that the upper surface of the first rack member 610 is in close contact with and fixed to the lower surface of the receiving part 220, and the second rack member 620 may be installed at the lower surface of the first rack member 610 such that second rack member 620 can slide forward and rearward.

Particularly, in a state in which the second rack member 620 is located to be received in the first rack member 610, when the first rack member 610 moves forward a set distance, the second rack member 620 may receive the rotational force of the pinion 410 while being moved forward by the first rack member 610. While the second rack member 620 is continuously moved forward by the rotational force of the pinion 410, the second rack member 620 may be configured to further withdraw the first rack member 610 although the rack 611 of the first rack member 610 moves out of the pinion 410.

Figure 15:
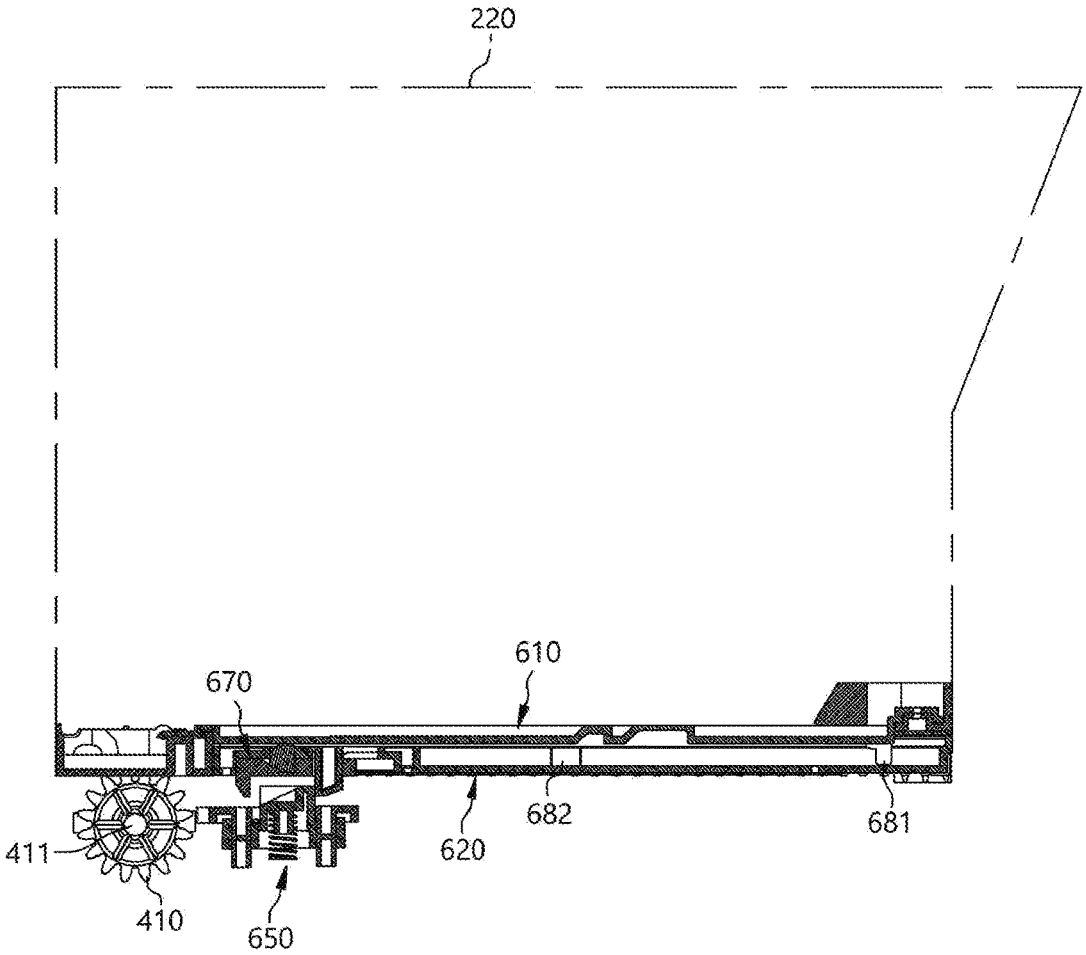
FIGS. 15 to 17 are operation state views illustrating the operation state of the rack gear assembly in a process in which a receiving part of the refrigerator according to the embodiment of the present disclosure is opened.
Figure 16:
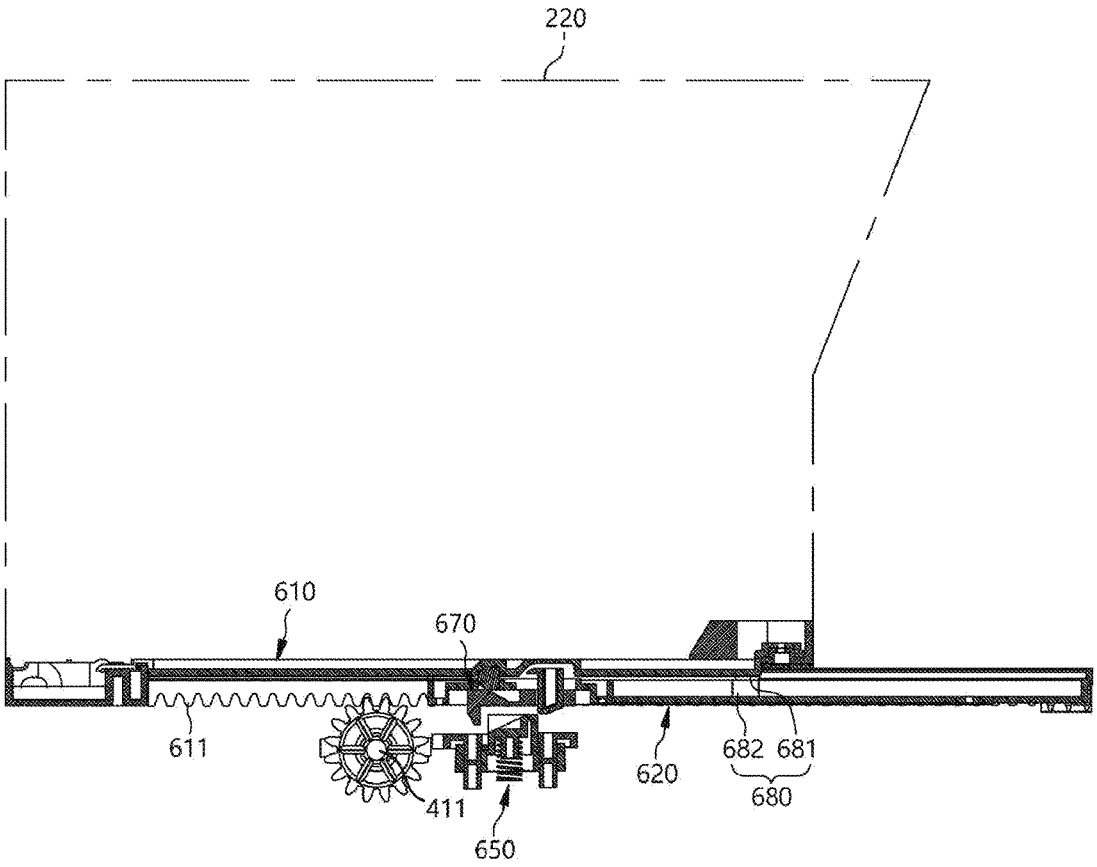
Figure 17:
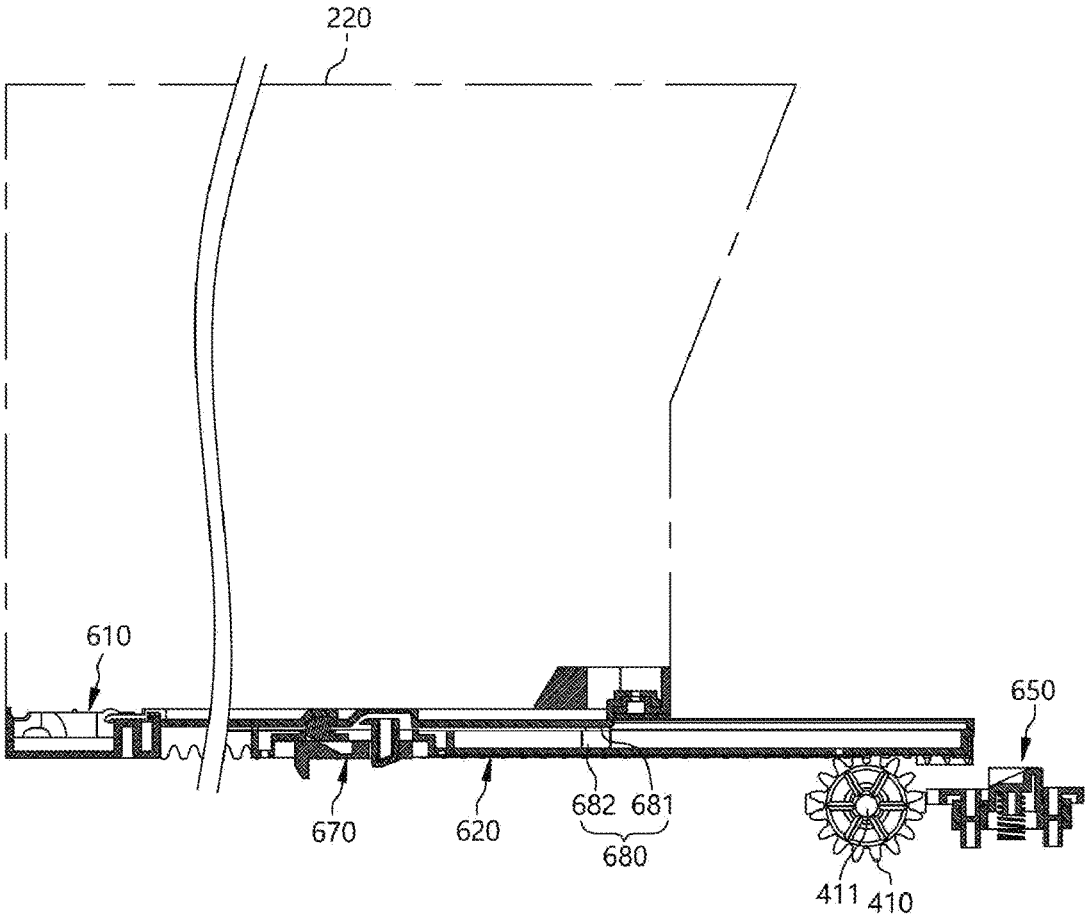

In this case, the first rack member 610 may be configured to lead and move the second rack member 620 through the interlocking part 680. The interlocking part 680 may include an interlocking protrusion 681 to be described later formed at the lower surface (a lower surface of the inside of a moving guide groove) of the first rack member 610, and an interlocking jaw 682 formed on the upper surface of the second rack member 620. When the first rack member 610 moves forward a preset distance, the first rack member 610 may be configured to move the second rack member 620 forward by hitting the second rack member 620. Such an interlocking part is illustrated in FIGS. 15 to 17.

Although not shown, the interlocking protrusion 681 may be formed on the first rack member 610. In addition, although not shown, the interlocking protrusion 681 may be formed on the upper surface of the second rack member 620, and the interlocking jaw 682 may be formed on the lower surface of the first rack member 610.

Meanwhile, an idle gear 630 may be provided at the second rack gear assembly 601 or 602. The idle gear 630 is a component configured to assist the drawer 200 such that the opposite sides of the drawer 200 can be closed even if the drawer 200 is inserted slantingly, not horizontally.

The idle gear 630 may be configured such that the idle gear 630 may be engaged with the gear teeth of the pinion 410 and the pinion 410 may rotate idly. The idle gear 630 may be provided in the second rack gear assembly 602 of the two rack gear assemblies 601 and 602.

That is, in the first rack gear assembly 601, the rack 611 of the first rack member 610 may be continuously formed up to the front end of the first rack member 610, and in the second rack gear assembly 602, the rack 611 of the first rack member 610 may not be formed up to the front end of the first rack member 610 to be shorter than the rack 611 of the first rack gear assembly 601, and the idle gear 630 may be provided at the front of the rack 611 of the second rack gear assembly 602. This is illustrated in FIGS. 9 and 10.

That is, the idle gear 630 may be installed at a position at which the idle gear 630 can be engaged with the pinion 410 in a state in which the drawer 200 is closed. The gear teeth of such an idle gear 630 may be engaged with the gear teeth of the pinion 410 and may selectively move up and down such that the pinion 410 can rotate idly.

Next, the refrigerator according to the embodiment of the present disclosure may include a detection part 700 (See FIG. 13) configured to detect the opening and closing of the drawer 200. That is, due to the provision of the detection part 700, whether the drawer 200 is completely opened may be accurately detected.

Such a detection part 700 may include the reed switch 710 and the opening-detection magnet 720. Particularly, the reed switch 710 may be provided at the bottom surface of the inside of the lower storage compartment 3, and the opening-detection magnet 720 may be provided at the lower surface of the receiving part 220 constituting the drawer 200.

More specifically, the reed switch 710 may be located at the cover plate 510 (See FIG. 6) installed removably at the bottom of the inside of the lower storage compartment 3, and the opening-detection magnet 720 may be located at a position of the first rack gear assembly 601 (See FIGS. 9 to 11) located at a position facing the reed switch 710. Since the cover plate 510 is removable from the cabinet, the maintenance of the reed switch 710 may be easily performed.

Figure 12:
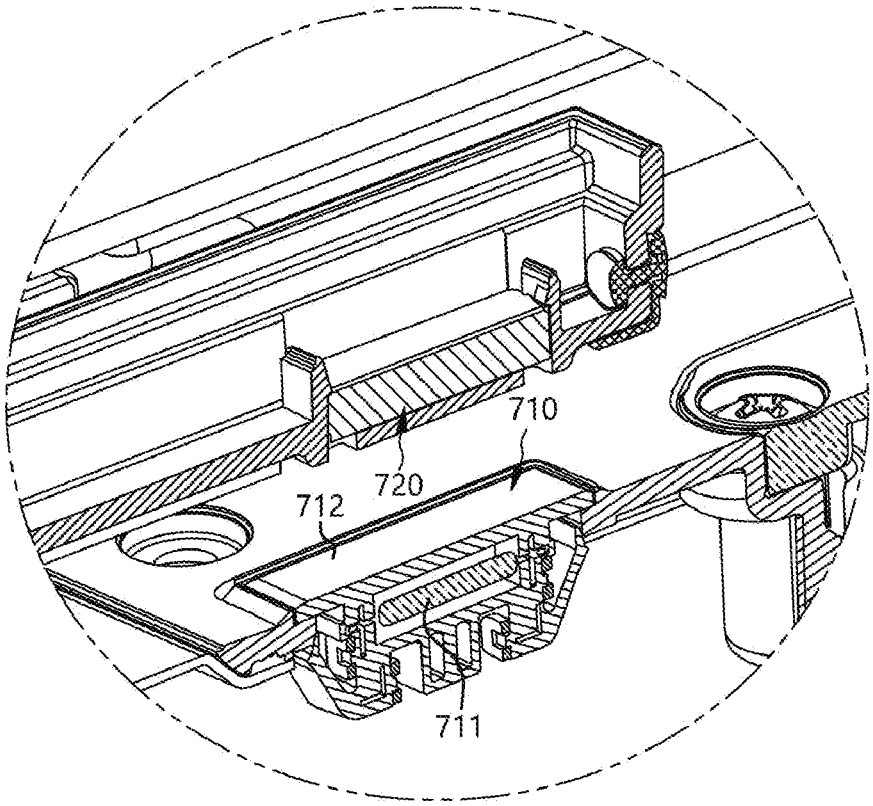
FIG. 12 is a perspective view illustrating the arranged state of a detection part of the refrigerator according to the embodiment of the present disclosure by cutting a portion of the detection part.
Figure 13:
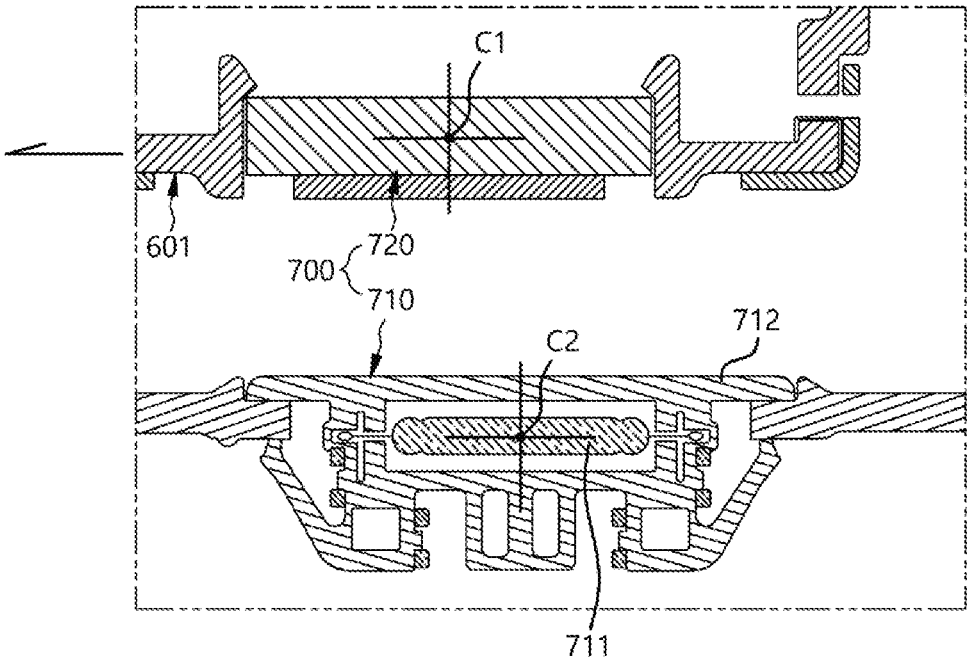
FIG. 13 is a sectional view illustrating the arranged state of the detection part of the refrigerator according to the embodiment of the present disclosure.

In addition, as illustrated in FIGS. 12 and 13, the reed switch 710 may include the sensor 711 configured to detect the opening-detection magnet 720 and a protecting casing 712 protecting the sensor 711. In this case, the sensor 711 may be configured as a Hall sensor.

In addition, the sensor 711 of the reed switch 710 and the opening-detection magnet 720 may be configured to be longer in the moving direction of the drawer 200 than in the width of the drawer 200. That is, the sensor 711 and the opening-detection magnet 720 may be disposed such that the longitudinal direction of each of the sensor 711 and the opening-detection magnet 720 corresponds to the moving direction of the drawer 200. That is, when the drawer 200 is completely opened, due to the disposition described above, whether the drawer 200 is completely opened may be accurately detected despite a partial error of the forward/rearward moving distance of the drawer 200 for opening the drawer 200.

In addition, the reed switch 710 and the opening-detection magnet 720 may be located to face each other when the drawer 200 is completely opened. Particularly, as illustrated in FIG. 13, when the drawer 200 is completely opened, the center C1 of the opening-detection magnet 720 may be disposed to be located at a position exceeding the center C2 of the sensor 711 of the reed switch 710 in the moving direction (an opening direction) of the drawer 200.

That is, when the drawer 200 stops moving before the center C1 of the opening-detection magnet 720 reaches the center C2 of the sensor 711 of the reed switch 710, the opening-detection magnet 720 may be temporarily moved out of the detection area of the sensor 711 by various impacts (external impact occurring during the lifting of the container and external impact occurring when storing items in the container, etc.), which may cause the malfunction of the drawer 200 which is closed automatically.

In consideration of this, even if the external impacts described above occur when the center C1 of the opening-detection magnet 720 is disposed to be located at a position exceeding the center C2 of the sensor 711 in the moving direction of the drawer 200 when the drawer 200 is completely opened, the opening-detection magnet 720 may be prevented from moving out of the detection area of the sensor 711. That is, in consideration that the drawer does not move any longer in the opening direction of the drawer in the state in which the drawer 200 is completely opened, when external impact is applied to the drawer 200, the drawer 200 may move only in the closing direction thereof. Despite the occurrence of such movement, the opening-detection magnet 720 may be located in the detection area of the sensor 711, so the malfunction of the drawer 200 which is closed automatically may be prevented.

Of course, in a case in which the center C1 of the opening-detection magnet 720 is set to be located to excessively exceed the center C2 of the sensor 711, when the drawer 200 is completely opened, the opening-detection magnet 720 may be located outside the detection area of the sensor 711. Accordingly, when the drawer 200 is completely opened, the rear end of the opening-detection magnet 720 is preferably disposed not to exceed the center C2 of the sensor 711 of the reed switch 710.

More specifically, when the drawer 200 is completely opened, the rear end of the opening-detection magnet 720 is preferably disposed to be located in the detection area of the sensor 711 of the reed switch 710.

Figure 14:
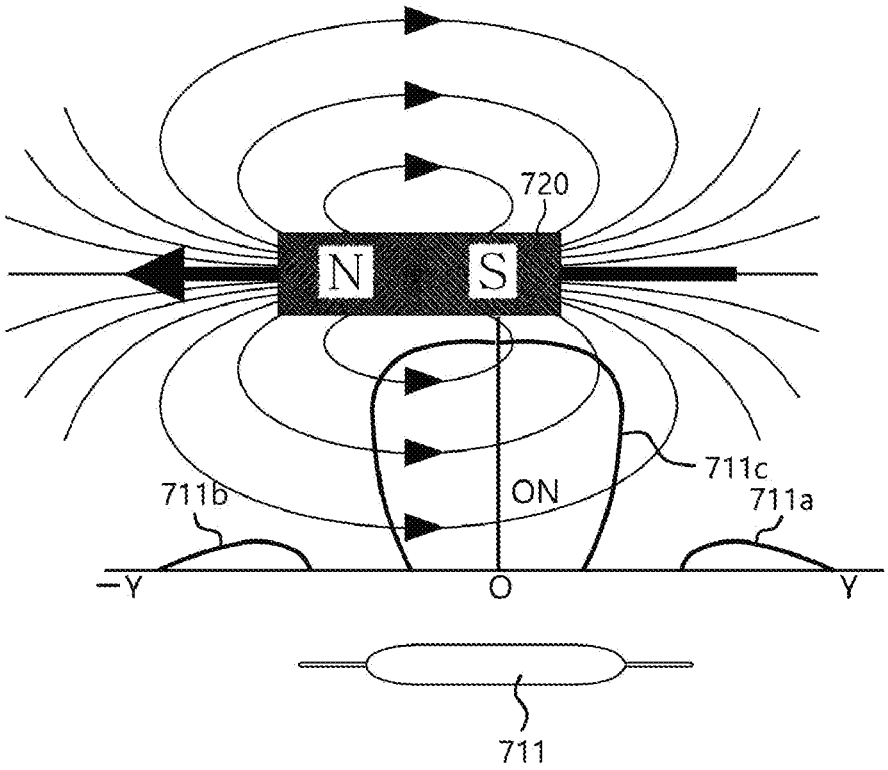
FIG. 14 is a state view roughly illustrating each detection area detected by the sensor of the detection part of the refrigerator according to the embodiment of the present disclosure.

Meanwhile, as illustrated in FIG. 14, the sensor 711 constituting the reed switch 710 may include a first detection area 711*a* for detecting the opening-detection magnet 720 at a portion behind the sensor 711, a second detection area 711*b* for detecting the opening-detection magnet 720 at a portion in front of the sensor 711, and a third detection area 711*c* for detecting the opening-detection magnet 720 at a portion at which the sensor 711 is located.

Particularly, the third detection area 711*c* of the sensor 711 may be designed to be better in detection sensitivity than the first detection area 711*a* or the second detection area 711*b*. That is, even if the opening-detection magnet 720 is spaced apart from the first detection area 711*a* or the second detection area 711*b* such that the opening-detection magnet 720 cannot be detected in the first detection area 711*a* or the second detection area 711*b*, the opening-detection magnet 720 may be detected in the third detection area 711*c*.

For example, the first detection area 711*a* and the second detection area 711*b* may be designed such that the opening-detection magnet 720 is detected in the first detection area 711*a* and the second detection area 711*b* when the opening-detection magnet 720 is located within 10 mm from the surface of the sensor 711 opposite thereto, and the third detection area 711*c* may be designed such that the opening-detection magnet 720 is detected in the third detection area 711*c* when the opening-detection magnet 720 is located at the distance of 10 mm to 20 mm from the surface of the sensor 711 opposite thereto.

In addition, the opening-detection magnet 720 may be disposed to be located at the distance of 10 mm to 20 mm from the surface of the sensor 711 opposite thereto. That is, the opening-detection magnet 720 may be disposed not to be detected by the second detection area 711*b*, whereby even when the opening-detection magnet 720 is not located to correspond to a portion of the sensor 711 opposite thereto, the opening-detection magnet 720 may be prevented from being detected by the second detection area 711*b*. Specifically, when the drawer 200 is completely opened, the center C1 of the opening-detection magnet 720 may be located between the center of the third detection area 711*c* and the center of the second detection area 711*b*.

In addition, when the drawer 200 is completely opened, the rear end of the opening-detection magnet 720 may be disposed not to exceed the third detection area 711*c*. That is, even if the center C1 of the opening-detection magnet 720 moves to exceed the center of the third detection area 711*c*, the center C1 of the opening-detection magnet 720 may be located in the third detection area 711*c*, so the sensor 711 may detect the opening-detection magnet 720.

More preferably, the center C1 of the opening-detection magnet 720 may be configured to be located at a position exceeding, by a predetermined distance, the center of the third detection area 711*c* (or the center of the sensor in a longitudinal direction thereof). In this case, the predetermined distance may be a distance between the gear teeth of the pinion 410 or a distance between the gear teeth of each of the racks 611 and 621.

That is, in a case in which external impact is applied to the drawer 200 while the drawer 200 is opening, the opposite sides of the drawer 200 may not move exactly in parallel but may move slantingly. Accordingly, even when the drawer 200 is completely opened, gear misalignment between the racks 611 and 621 of each of the rack gear assemblies 601 and 602 of the opposite sides of the drawer 200 and the pinion 410 may occur. Even in this case, the center C1 of the opening-detection magnet 720 may be located in the third detection area 711*c*.

Meanwhile, the reed switch 710 of the detection part 700 may be installed on the bottom surface of the inside of the lower storage compartment 3 of the cabinet 100 such that the reed switch 710 is located adjacently to the pinion 410, and the opening-detection magnet 720 may be installed to be located at the first rack gear assembly 601 of the lower surface (a surface facing the bottom surface of the lower storage compartment) of the receiving part 220 constituting the drawer 200.

That is, the pinion 410 and the racks 611 and 621 of the rack gear assembly 601 may be located to be engaged with each other. Accordingly, when the detection part 700 is located as adjacently as possible to the pinion 410 and the racks 611 and 621, a distance between the reed switch 710 and the opening-detection magnet 720 may always be maintained constant.

In addition, the detection part 700 may include two detection parts. The detection parts may be configured to be provided at opposing portions to each other, respectively, between the opposite sides of the bottom of the cabinet 100 and the opposite sides of the lower surface of the drawer 200, but it may be more preferable that only one detection part is provided as illustrated in the embodiment.

That is, in the case in which the detection part 700 includes two detection parts, the detection timings of the two detection parts 700 may not match exactly, and thus a detection error may occur. In consideration of this, it is preferable to prevent the above detection error by providing one detection part 700. In the case in which one detection part 700 is provided, the opening-detection magnet 720 of the detection part 700 may be located at the first rack gear assembly 601 at a side at which the idle gear 630 is not located, and the reed switch 710 may be located to face the opening-detection magnet 720.

In addition, a separate closing-detection magnet (or second magnet) 730 may be provided at the front end of the lower surface of the first rack gear assembly 601. That is, when the drawer 200 is completely closed, the reed switch 710 may detect the complete closing of the drawer 200 by detecting the closing-detection magnet 730. Particularly, when the drawer 200 is completely closed, the center of the closing-detection magnet 730 may be disposed to be located by exceeding the center C2 of the sensor 711 of the reed switch 710 in the moving direction (a closing direction) of the drawer 200.

In the disposed structure of such a closing-detection magnet 730, the drawer 200 may be completely closed, and like the disposed structure of the opening-detection magnet 720 described above, the closing-detection magnet 730 may be prevented from being moved out of the detection area (the third detection area) of the sensor 711 of the reed switch 710 despite external impact applied to the drawer 200 in the closed state of the drawer 200.

Meanwhile, unexplained reference numerals 650 and 670 of FIGS. 15 to 17 indicate a restraining protruding part 650 and a restraining module 670 provided to prevent the forward movement of the second rack member 620 before the first rack member 610 is withdrawn by a preset distance.

Hereinafter, the operation process of the drawer 200 of the refrigerator according to the embodiment of the present disclosure will be described. First, the drawer 200 may remain closed unless otherwise manipulated, which is illustrated in FIGS. 4 and 15.

In this closed state of the drawer 200, when a manipulation for opening the drawer 200 is performed according to a user's need, power may be supplied to the drive part 400, and the drive motor 420 may operate. In this case, the manipulation for opening the drawer 200 may be the manipulation of the button 6 (a touch-type button or a press-type button) or the control of the operation of the control program detecting a user' proximity.

In addition, when the drive motor 420 is operated by the manipulation, the two pinions 410 may simultaneously rotate and thus the racks 611 and 621 of each of the two rack gear assemblies engaged with the two pinions 410 may operate and the drawer 200 may open forward. More specifically, as illustrated in FIGS. 15 to 18, after the first rack member 610 is first withdrawn, the second rack member 620 may be withdrawn.

In addition, when the first rack member 610 is withdrawn by a preset first distance and the interlocking protrusion 681 is in contact with the interlocking jaw 682, the second rack member 620 may move forward together with the first rack member 610 from the point when the interlocking protrusion 681 is in contact with the interlocking jaw 682. This is illustrated in FIG. 16.

Figure 18:
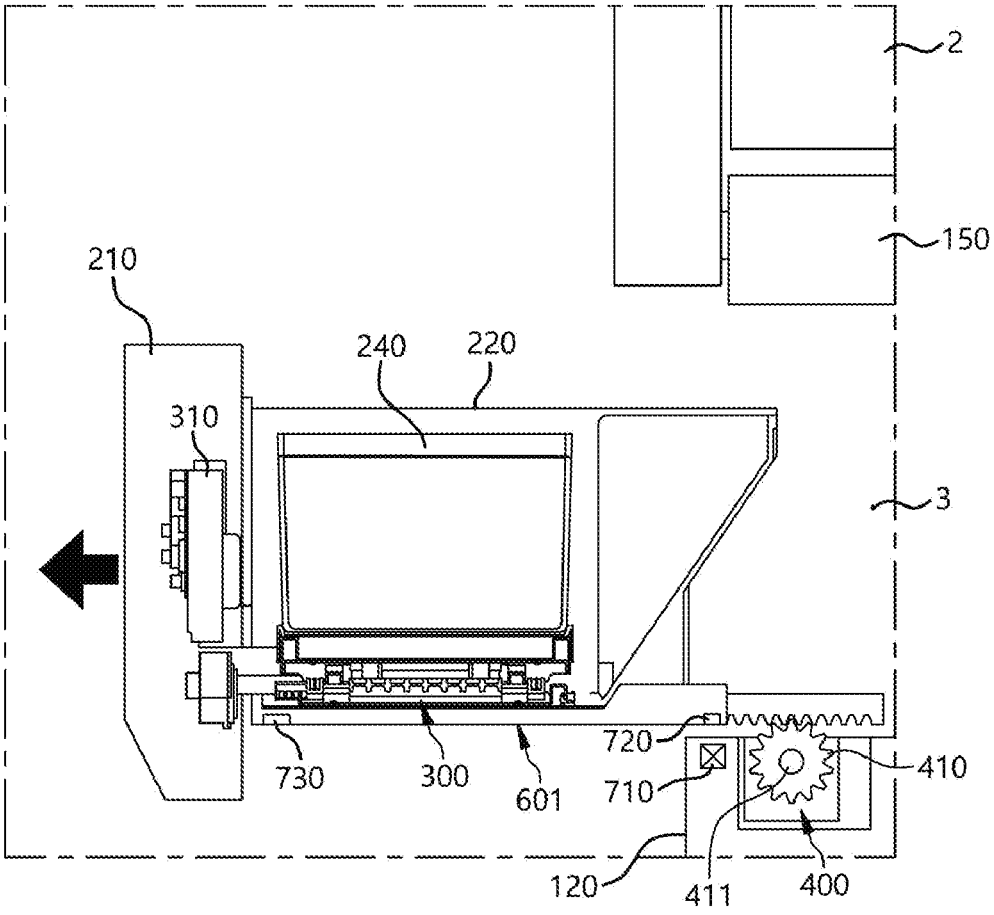
FIGS. 18 and 19 are operation state views illustrating the process in which the receiving part of the refrigerator according to the embodiment of the present disclosure is opened.

Continuously, immediately before the rack 611 of the first rack member 610 moves out of the pinion 410 while the second rack member 620 is moving by following the first rack member 610, the rack 621 of the second rack member 620 may be engaged with the pinion 410, and at the same time when the rack 611 of the first rack member 610 moves out of the pinion 410, only the rack 621 of the second rack member 620 may move in engagement with the pinion 410 due to the rotation of the pinion 410 to further move the drawer 200 forward. This is illustrated in FIGS. 17 and 18.

In addition, when the movement of the second rack member 620 described above is completed, the drawer 200 may be maximally opened. In addition, as illustrated in FIG. 13, when the drawer 200 is maximally opened, the center C1 of the opening-detection magnet 720 provided at the lower surface of the drawer 200 may be located to exceed the center C2 of the sensor 711 of the reed switch 710 provided at the bottom of the inside of the lower storage compartment 3.

That is, the rear end of the opening-detection magnet 720 may be located not to exceed the center C2 of the sensor 711, and the center C1 of the opening-detection magnet 720 may be located between the center of the third detection area 711*c* and the first detection area 711*a* at which the sensor 711 detects the opening-detection magnet 720. Accordingly, the sensor 711 of the reed switch 710 may accurately detect the opening-detection magnet 720, and a detection signal may be transmitted to a controller (not shown), so the operation of the drive motor 420 may stop.

Particularly, when the operation of the drive motor 420 stops, the drawer 200 may be moved (particularly, moved rearward) by a predetermined distance (for example, a distance of about one pitch between each of the gear teeth of the pinion or the rack) due to the environment of the inside of the refrigerator (for example, pressure difference in the refrigerator and difference between refrigeration and freezing conditions, etc.), the weight of items stored in the container 240, or the freezing or gear misalignment of each of the rack gear assemblies 601 and 602.

However, even if the drawer 200 is moved (moved rearward) by a predetermined distance, the center C1 of the opening-detection magnet 720 may be located in the third detection area 711*c* at which the sensor 711 detects the opening-detection magnet 720, so the unintentional reverse operation of the drive motor 420 may be prevented. That is, in a case in which the opening-detection magnet 720 moves out of the detection area of the sensor 711 due to the minute rearward movement of the drawer 200, the controller may be prevented from reversely operating the drive motor 420 by determining this as the closing manipulation of the drawer 200.

Figure 19:
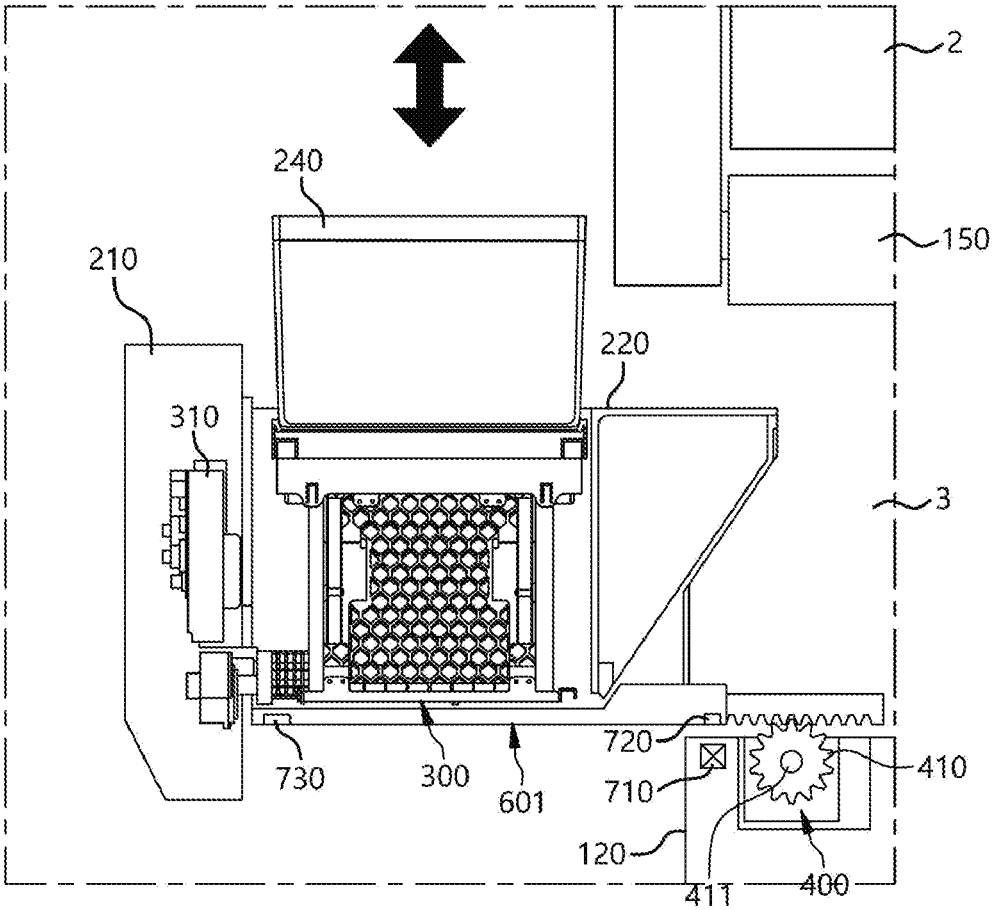

In addition, in a state in which the sensor 711 of the reed switch 710 detects the opening-detection magnet 720, the controller receiving the detection signal may control the lift module 300 so as to move the container 240 up, which is located inside the receiving part 220. This is illustrated in FIGS. 3 and 19.

Accordingly, a user may conveniently take out the container 240, take out items stored in the container 240, or store items in the container 240. Meanwhile, while a user stores items in the container 240 or takes out items therefrom, external impact may be applied to the drawer 200 due to the carelessness of the user. Particularly, when external impact is applied to the drawer 200, the drawer 200 may instantaneously be moved in the closing direction thereof.

However, even if the movement of the drawer 200 described above occurs, the opening-detection magnet 720 may be located in the third detection area 711*c* of the sensor 711 constituting the reed switch 710, so the malfunction of the drawer 200 (the reverse operation of the drive motor) may be prevented. Of course, due to the arranged structure of the sensor 711 and the opening-detection magnet 720, when a user closes the drawer 200, the user's initial force may be required to increase by corresponding to the arranged structure.

However, the user's initial force to be additionally provided may be only as large as a force of about one pitch of each of the gear teeth pitch compared to the existing required force, so it is difficult for the user to perceive the additional initial force. In consideration of this, even if a larger initial force is required, it is more preferable to design the detection part 700 such that the detection error is prevented as in the embodiment of the present disclosure.

In addition, when the pushing manipulation of the drawer 200 is performed in the closing direction thereof to close the drawer 200 after a user completes the use of the drawer, the opening-detection magnet 720 may exceed the third detection area 711*c* of the sensor 711. In this case, the controller may drive the drive motor 420 constituting the drive part 400 and may control the pinion 410 such that the pinion 410 rotates reversely. Accordingly, the rack 621 of the second rack member 620 engaged with the pinion 410 may operate and may move the second rack member 620 rearward. In this case, since the first rack member 610 is pulled by the second rack member 620 due to the interlocking part 680, the first rack member 610 may move backward together with the second rack member 620.

Next, when the front end of the rack 621 of the second rack member 620 is positioned to be engaged with the pinion 410, the rear end of the rack 611 of the first rack member 610 may also be positioned to be engaged with the pinion 410. Subsequently, the rack 621 of the second rack member 620 may move away from the pinion 410, and only the first rack member 610 may be moved backward by the rack 611 thereof.

In addition, when the rack gear assemblies 601 and 602 are returned to initial positions thereof (a position at which the receiving part is completely closed), the closing-detection magnet 730 located at the front of the first rack gear assembly 601 may be located to correspond to the reed switch 710. This is illustrated in FIG. 4.

Accordingly, the sensor 711 of the reed switch 710 may detect the closing-detection magnet 730. Particularly, when the drawer 200 is completely closed, the center C1 of the closing-detection magnet 730 may be disposed to be located by exceeding the center C2 of the sensor 711 of the reed switch 710 in the moving direction (the closing direction) of the drawer 200. Accordingly, when the sensor 711 detects the closing-detection magnet 730, the drawer 200 may be completely closed. Of course, even if external impact is applied to the drawer 200 in the closed state of the drawer 200, the closing-detection magnet 730 may be prevented from exceeding the third detection area of the sensor 711 of the reed switch 710.

In addition, when it is detected that such a returning operation is completed, the operation of the drive motor 420 may stop and the closing operation of the drawer 200 may stop. As described above, in the refrigerator of the present disclosure, when the drawer 200 is completely opened, the center C1 of the opening-detection magnet 720 constituting the detection part 700 may be disposed to be located at a position exceeding the center C2 of the sensor 711 of the reed switch 710, thereby enabling the sensor 711 to accurately detect the opening-detection magnet 720.

In addition, in the refrigerator of the present disclosure, when the drawer 200 is completely opened, the center C1 of the opening-detection magnet 720 may be located at a position exceeding the center C2 of the sensor 711 of the reed switch 710, thereby preventing the opening-detection magnet 720 from moving out of the detection area of the sensor 711 despite the movement of the drawer 200 caused by external impact instead of the closing manipulation of the drawer in the opened state of the drawer 200.

In addition, in the refrigerator of the present disclosure, the position of the opening-detection magnet 720 may be determined such that the opening-detection magnet 720 can be detected in only the third detection area 711*c* of a portion at which the sensor is located among the first detection area 711*a*, the second detection area 711*b*, and the third detection area 711*c* at which the sensor detects the opening-detection magnet 720 in the longitudinal direction thereof, thereby more accurately detecting the opening-detection magnet 720. Meanwhile, the refrigerator of the present disclosure is not limited to the structure of the refrigerator according to the embodiment described above.

Although not shown, the reed switch 710 constituting the detection part 700 may include a plurality of reed switches along the moving direction of the drawer 200. That is, the drawer 200 may be configured to be closed only when the opening detection magnet 720 reaches the position of each of the plurality of reed switches 710 such that the unintentional closing of the drawer 200 due to the detection error can be prevented.

In addition, the reed switch 710 and the opening detection magnet 720 of the detection part 700 of the present disclosure are not limited to be installed at the bottom of the lower storage compartment 3 of the inside of the cabinet 100 and the lower surface of the drawer 200, respectively, the bottom of the lower storage compartment 3 and the lower surface of the drawer 200 facing each other.

Although not shown, the opening-detection magnet 720 may be provided on the bottom of the inside of the lower storage compartment 3 and the reed switch 710 may be provided on the lower surface of the receiving part 220. Of course, the reed switch 710 may be provided on any one side wall surface of the inside of the lower storage compartment 3, and the opening-detection magnet 720 may be provided on a wall surface facing the receiving part 220. Accordingly, the detection part constituting the refrigerator of the present disclosure may be variously embodied.

Accordingly, the present disclosure has been made keeping in mind the above problems occurring in the related art, and the present disclosure is intended to propose a refrigerator in which when a drawer is opened, the error of detection by a reed switch may be prevented. In addition, the present disclosure is intended to propose a refrigerator in which although the drawer moves due to external impact applied to the drawer while the drawer is opened and used, the detection error of the reed switch may be prevented. In addition, the present disclosure is intended to propose a refrigerator in which even if the opening distance of the drawer changes due to environmental conditions, the opening of the drawer may be accurately detected.

In order to achieve the above aspects, according to the refrigerator of the present disclosure, when a drawer is completely opened, the center of the opening-detection magnet provided at the lower surface of the drawer may be disposed to be located at a position exceeding the center of the sensor of a reed switch installed at the bottom surface of the inside of a cabinet in the moving direction of the drawer.

In addition, in the refrigerator of the present disclosure, the opening-detection magnet and the sensor of the reed switch may be configured to be longer in the moving direction of the drawer than in the width direction thereof. In addition, in the refrigerator of the present disclosure, when the drawer is completely opened, the rear end of the opening-detection magnet may be disposed not to exceed the center of the sensor of the reed switch.

In addition, in the refrigerator of the present disclosure, when the drawer is completely opened, the rear end of the opening-detection magnet may be disposed to be located in the detection area of the sensor of the reed switch. In addition, in the refrigerator of the present disclosure, the sensor constituting the reed switch may be configured to have a first detection area for detecting the opening-detection magnet at a portion behind the sensor, a second detection area for detecting the opening-detection magnet at a portion in front of the sensor, and a third detection area for detecting the opening-detection magnet at a portion at which the sensor is located.

In addition, in the refrigerator of the present disclosure, the sensor constituting the reed switch may be configured such that the opening-detection magnet is detected up to the third detection area located at a position more away from the sensor than the first detection area or the second detection area. In addition, in the refrigerator of the present disclosure, when the drawer is completely opened, the center of the opening-detection magnet may be located between the center of the third detection area and the center of the second detection area.

In addition, in the refrigerator of the present disclosure, when the drawer is completely opened, the rear end of the opening-detection magnet may be disposed not to exceed the third detection area. In addition, in the refrigerator of the present disclosure, the opening-detection magnet may be disposed to be spaced apart from the sensor in a direction opposite thereto such that the opening-detection magnet cannot be detected in the first detection area and the second detection area of the sensor but can be detected in the third detection area.

As described above, in the refrigerator of the present disclosure, when the drawer is completely opened, the center of the magnet constituting the detection part may be disposed to be located at a position exceeding the center of the sensor of the reed switch, thereby enabling the sensor to accurately detect the magnet. In addition, in the refrigerator of the present disclosure, when the drawer is completely opened, the center of the magnet may be located at a position exceeding the center of the sensor of the reed switch, thereby preventing the magnet from moving out of the detection area of the sensor despite the movement of the drawer caused by external impact instead of the closing manipulation of the drawer in the opened state of the drawer.

In addition, in the refrigerator of the present disclosure, the position of the magnet may be determined such that the magnet can be detected in only the third detection area of a portion at which the sensor is located among the first detection area, the second detection area, and the third detection area at which the sensor detects the magnet in the longitudinal direction thereof, thereby more accurately detecting the magnet.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage compartment;

a drawer installed at the storage compartment so as to slide forward and rearward and configured to open and close the storage compartment;

a first magnet provided at a lower surface of the drawer; and a reed switch having a sensor configured to detect the first magnet, wherein when the drawer is completely opened, a center of the first magnet is positioned to be located past a center of the sensor of the reed switch in a moving direction of the drawer, and wherein in the completely open state of the drawer a rear end of the first magnet is positioned not to pass the center of the sensor of the reed switch in the moving direction of the drawer.

2. The refrigerator of claim 1, wherein the first magnet and the sensor of the reed switch are formed to be longer in the moving direction of the drawer than in a width direction of the drawer.

3. A refrigerator comprising:

a cabinet having a storage compartment;

a drawer installed at the storage compartment so as to slide forward and rearward and configured to open and close the storage compartment;

a first magnet provided at a lower surface of the drawer; and a reed switch having a sensor configured to detect the first magnet, wherein when the drawer is completely opened, a center of the first magnet is positioned to be located past a center of the sensor of the reed switch in a moving direction of the drawer, and wherein when the drawer is completely opened, a rear end of the first magnet is positioned to be located in a detection area of the sensor of the reed switch.

4. A refrigerator comprising:

a cabinet having a storage compartment;

a drawer installed at the storage compartment so as to slide forward and rearward and configured to open and close the storage compartment;

a first magnet provided at a lower surface of the drawer; and a reed switch having a sensor configured to detect the first magnet, wherein when the drawer is completely opened, a center of the first magnet is positioned to be located past a center of the sensor of the reed switch in a moving direction of the drawer, and wherein the sensor is configured to detect the first magnet when positioned in a detection area at a portion of a moving path of the drawer in front of the sensor in the moving direction of the drawer, and to detect the first magnet when positioned in another detection area at a portion of the moving path of the drawer at which the sensor is located, the sensor being configured to have better detection sensitivity in the other detection area at the portion of the moving path of the drawer at which the sensor is located than in the detection area at the portion of the moving path of the drawer in front of the sensor.

5. A refrigerator comprising:

a cabinet having a storage compartment;

a drawer installed at the storage compartment so as to slide forward and rearward and configured to open and close the storage compartment;

a first magnet provided at a lower surface of the drawer; and a reed switch having a sensor configured to detect the first magnet, wherein when the drawer is completely opened, a center of the first magnet is positioned to be located past a center of the sensor of the reed switch in a moving direction of the drawer, and wherein the sensor detects the first magnet in a first detection area behind the sensor, a second detection area in front of the sensor, and a third detection area in which the sensor is located, the sensor being configured to have better detection sensitivity in the third detection area than in the second and second detection areas.

6. The refrigerator of claim 5, wherein when the drawer is completely opened, the center of the first magnet is located between a center of the third detection area and the first detection area.

7. The refrigerator of claim 5, wherein when the drawer is completely opened, a rear end of the first magnet is positioned not to be located past the third detection area.

8. The refrigerator of claim 5, wherein the first magnet is positioned such that the first magnet is not detected in the second detection area of the sensor but is detected in the third detection area when the drawer is completely opened.

9. The refrigerator of claim 1, wherein a pinion is provided at the bottom surface of the cabinet, and a rack gear assembly is provided at the lower surface of the drawer, the rack gear assembly having a rack such that the rack gear assembly operates in engagement with the pinion.

10. The refrigerator of claim 9, wherein the reed switch is located adjacent to the pinion.

11. The refrigerator of claim 9, wherein when the drawer is completely opened, a distance by which the center of the first magnet is positioned past the center of the sensor corresponds to a distance between each of gear teeth of the pinion.

12. The refrigerator of claim 9, wherein when the drawer is completely opened, a distance by which the center of the first magnet is positioned past the center of the sensor corresponds to a distance between each of gear teeth of the rack.

13. The refrigerator of claim 1, wherein a cover plate is installed removably at a bottom surface of the cabinet, and the reed switch is located at the cover plate.

14. The refrigerator of claim 1, wherein the reed switch is installed at a bottom surface of the storage compartment.

15. The refrigerator of claim 1, further comprising a second magnet that is provided at the lower surface of the drawer, wherein the sensor is configured to detect the second magnet when the drawer is closed.

16. A refrigerator comprising:

a cabinet having a storage compartment;

a drawer installed at the storage compartment so as to slide forward and rearward and configured to open and close the storage compartment;

a magnet provided at a lower surface of the drawer; and a reed switch having a sensor configured to detect the magnet, wherein:

the sensor has a first detection area behind the sensor in a moving direction of the drawer, a second detection area in front of the sensor, and a third detection area in which the sensor is located, the sensor being configured to have a better detection sensitivity in the third detection area than the first detection area or the second detection area, and the magnet is positioned such that the magnet is not detected in the second detection area of the sensor and is detected in the third detection area of the sensor when the drawer is completely opened.

17. The refrigerator of claim 16, wherein the reed switch is installed at a bottom surface of the storage compartment.

18. The refrigerator of claim 16, further comprising a pinion provided at the bottom surface of the cabinet, and a rack gear assembly provided at the lower surface of the drawer, the rack gear assembly having a rack such that the rack gear assembly operates in engagement with the pinion, wherein the reed switch is located adjacent to the pinion.

19. The refrigerator of claim 16, further comprising:

a motor to move the drawer; and a controller to deactivate the motor when the drawer is positioned such that the sensor detects the magnet.

* * * * *